US005170708A

United States Patent [19]

DiLalla

[11] Patent Number: 5,170,708

[45] Date of Patent: Dec. 15, 1992

[54] REGISTER CONTROL DEVICE FOR A PRINTING PRESS

[75] Inventor: Pascal DiLalla, Pierrefonds, Canada

[73] Assignee: RDP Marathon Inc., Canada

[21] Appl. No.: 816,006

[22] Filed: Jan. 2, 1992

[51] Int. Cl.[5] ..... B41F 13/24

[52] U.S. Cl. ..... 101/248; 318/85; 318/601; 226/30; 364/469

[58] Field of Search ..... 101/248, 216, 219, 232, 101/g230202185, 136-145; 318/85, 601; 226/27, 28, 29, 30; 364/469

[56] References Cited

U.S. PATENT DOCUMENTS

| | | | |
|---|---|---|---|
| 2,205,255 | 6/1940 | Gulliksen . | |
| 3,073,997 | 1/1963 | Tagliasacchi | 318/85 |
| 3.841,216 | 10/1974 | Huffman | 101/248 |
| 4,047,085 | 9/1977 | Ollendick | 101/181 |
| 4,220,084 | 9/1980 | MacLean et al. | 101/248 |
| 4.264,957 | 4/1981 | Pautzke | 226/28 |
| 4,318,176 | 3/1982 | Stratton et al. | 364/469 |
| 4,458,893 | 7/1984 | Ruh | 101/248 |
| 4,484,522 | 11/1984 | Simeth | 101/181 |
| 4,527,788 | 7/1985 | Masuda | 101/248 |
| 4,581,993 | 4/1986 | Schoneberger | 101/217 |
| 4,635,546 | 1/1987 | Grossman et al. | 101/248 |
| 4,898,094 | 2/1990 | Doumoto et al. | 101/181 |
| 4,994,975 | 2/1991 | Minschart | 364/469 |

*Primary Examiner*—Eugene H. Eickholt
*Attorney, Agent, or Firm*—Larson and Taylor

[57] ABSTRACT

A system for controlling the connection and disconnection of a drive to a rotary cylinder of a printing press. The system comprises a position encoder coupled to a first cylinder of the press for generating at different instants in time two pulses when the first cylinder is rotated to increment its peripheral position by a predetermined amount. A validation gate receives the pulses and generates a single position increment pulse in response thereto. A counter, coupled to the validation gate, counts the position increment pulses and generates a revolution pulse every time the first cylinder effects a complete revolution with respect to a fixed reference point. The system also comprises a coupling unit in an operative relationship with the drive and with a second cylinder. The coupling unit is selectively de-actuatable to terminate a driving relationship between the drive and the second cylinder in response to the revolution pulse and is also selectively actuatable to re-establish the driving relationship in response to the revolution pulse, whereby the driving relationship is terminated and reestablished only when the first cylinder is at the fixed referenced point.

14 Claims, 6 Drawing Sheets

REGISTER CONTROL DEVICE FOR A PRINTING PRESS

FIELD OF THE INVENTION

The invention relates to printing presses and particularly to a system for controlling the connection and the disconnection of the drive to a rotary cylinder of a printing press to allow one or more modules of the press to be disengaged from the drive and re-engaged later without loosing the original registration between the press modules.

BACKGROUND OF THE INVENTION

Typically, printing presses have a modular construction and comprise several stations which perform different operations on the web. For example, the first station creates an inked impression on the web, the second station prints page numbers, the third station perforates the web to create transverse tear lines, etc. For a proper operation of the press, all the modules are synchronised and driven by a single prime mover through a system of gears. By this arrangement, the angular positions of the various cylinders in rolling contact with the web evolve in strict registry one relatively to the other.

During a production run, routine maintenance procedures require to clean one or more of the rotary cylinders of the press. This is achieved by disengaging from the drive the modules that do not need maintenance, while the modules in need of service are operated to rotate the cylinders and wash them with the appropriate cleaning agent. When the cleaning operation is completed, the disengaged modules are reengaged back with the drive and the operation of the press is resumed. It is critical that the re-engagement occurs in such a way as to maintain the pre-established registry between the various press modules. If the registry is lost, the printing operation cannot be carried out.

OBJECTS AND STATEMENT OF THE INVENTION

An object of the present invention is a system for controlling the connection and disconnection of a drive to a rotary cylinder of a printing press which allows to disengage a certain module of the press from the drive and reengage back the module in registry with the other press modules.

Other objects of the invention will become apparent from the ensuing description.

As embodied and broadly described herein, the invention provides a system for controlling the connection and disconnection of a drive to a rotary cylinder of a printing press, the system comprising:

a position encoder coupled to a first rotary cylinder of the printing press for generating two pulses occurring at different instants in time when the first cylinder is rotated to increment its peripheral position by a predetermined amount, whereby when the first cylinder is continuously rotated the position encoder produces two out of phase pulse signals representative of the peripheral position of the first cylinder with respect to a fixed reference point;

a validation gate receiving the out of phase signals and generating a single position increment pulse in response to a pulse from each of the out of phase signals;

a counter for counting the position increment pulses and generating a revolution pulse when the first cylinder effects a complete revolution with respect to the fixed reference point; and a coupling unit connecting the drive with the second cylinder, the coupling unit being responsive to the counter and being selectively de-actuatable to terminate a driving relationship between the drive and the second cylinder when the drive is at a position reached at an instant determined by the time of origin of a revolution pulse, the coupling unit being selectively actuatable to re-establish the driving relationship when the drive is at the last mentioned position, whereby the drive is disconnected from and connected back to the second cylinder when the first cylinder is at the same position with respect to the fixed reference point, thereby allowing to re-acquire the registration between said cylinders existing before the drive has been disconnected from the second cylinder.

This system can be used to control the connection and the disconnection of a plurality of modules of the press by mounting the position encoder to a reference module and by providing an independent coupling unit between each module (except the reference module) and the press drive.

The use of a position encoder which is responsive to distance travelled by an arbitrary reference point at the periphery of the rotary cylinder driving the encoder, the system becomes very flexible in that it can be used with cylinders having various diameters without the necessity of physically changing the encoder in any way. For example, when the position encoder is used with a driving cylinder having a circumference of 17 inches and the drive between the cylinder and the position encoder is such that a position increment pulse is generated by the validation gate when the peripheral position of the cylinder is incremented by half of an inch, it suffices to set the counter to issue a revolution pulse at every 34 counts which corresponds to the number of position increments necessary to effect a complete revolution of the cylinder. Accordingly, the system can be adapted to various cylinder sizes simply by setting the counting cycle to the number of increments required to complete one turn of the cylinder.

In a preferred embodiment, the counter includes a reset input for restoring the counter to an initial value. This feature allows to set the angular position of the cylinder at which the revolution pulse will be generated. At this end, it suffices to rotate the cylinder until it has reached the desired angular position where the revolution pulse is to be generated and then reset the counter.

Preferably, the drive of the press is under the control of the coupling unit which regulates the speed of the drive when a signal is received by the coupling unit indicative that the drive is to be disengaged or reengaged with a certain module. The coupling unit monitors the output of the counter and when a revolution pulse is sensed, it initiates a drive stop procedure which consists firstly, of reducing the speed of the drive when the cylinder driving the position encoder has reached a predetermined position downstream of the fixed reference point and secondly, of stopping the drive completely when the cylinder driving the position encoder is at the fixed reference point, to allow the physical connection or disconnection of the selected module to be performed. This procedure permits to bring the drive at a full stop at a precise position and prevent overshooting by delaying the commencement of the drive stop procedure until the cylinder driving the position encoder has passed the fixed reference point In a preferred embodiment, a strobe light is provided which generates a flash of light in response to each revolution signal to provide to the observer a stationary image of the repeating frames of the web. A delay circuit is incorporated in the strobe light in order to delay by a predetermined period of time the incoming revolution pulses. This feature allows to adjust the position at which the burst of light will be produced with respect to the repeating web frame.

Preferably, the system in accordance with the invention also controls the web tensioner of the press in order to disengage the web tensioner when the drive is stopped to disengage a press module. As a result, the web tension is released when the modules are no longer maintained in registration by the drive to prevent some of the press cylinders to slightly roll back due to a frictional engagement with a strained web which is allowed to contract to an unstressed condition. When the module in re-engaged, the system delays the actuation of the web tensioner to allow the rotating cylinders of the press to pick-up the slack in the web.

DESCRIPTION OF A PREFERRED EMBODIMENT

Figure 1:
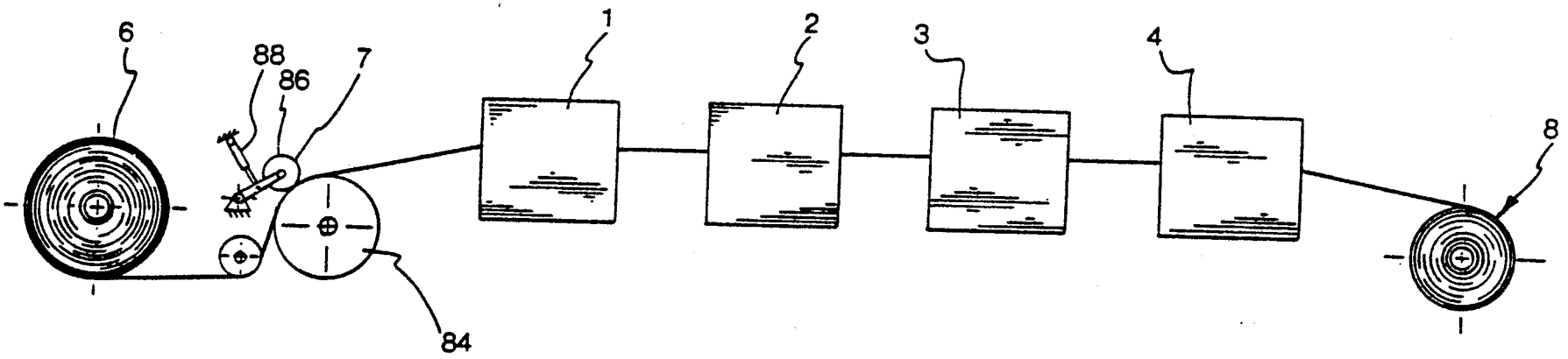
FIG. 1 is a schematical view of a printing press having a modular construction.

FIG. 1 illustrates a printing press of modular construction comprising a plurality of modules or stations 1 to 4 which are mounted in a spaced apart relationship on a common frame and are driven by a common prime mover (not shown in the drawings). Each press module comprises a plurality of rotary cylinders about which the web is trained in a serpentine path. The configuration of the various modules varies according to the intended application and it will not be described herein because it is not part of this invention.

The prime mover of the press can be an electric motor whose speed can be easily controlled by solid state power electronic controllers known in the art, which drives the rotary cylinders of each module through an elongated drive shaft (not shown in the drawings) connected to the various cylinders by gears.

More specifically, the modules 1 and 2 of the press apply inked impressions of different colours to the web 5, the module 3 prints page numbers and the module 4 transversally perforates the web to provide tear lines between the frames thereon. The web 5 is supplied from a reel 6 and passes through a web tensioner device 7 before entering the module 1. When the web has been processed by the last module 4, it is winded on a roll 8 or alternatively piled-up by any suitable conventionally constructed device.

The present invention provides a system 9 to control the drive of the printing press to allow the modules of the press to be disengaged and later reengaged in such a way as to always maintain the original registry between the modules.

Figure 2:
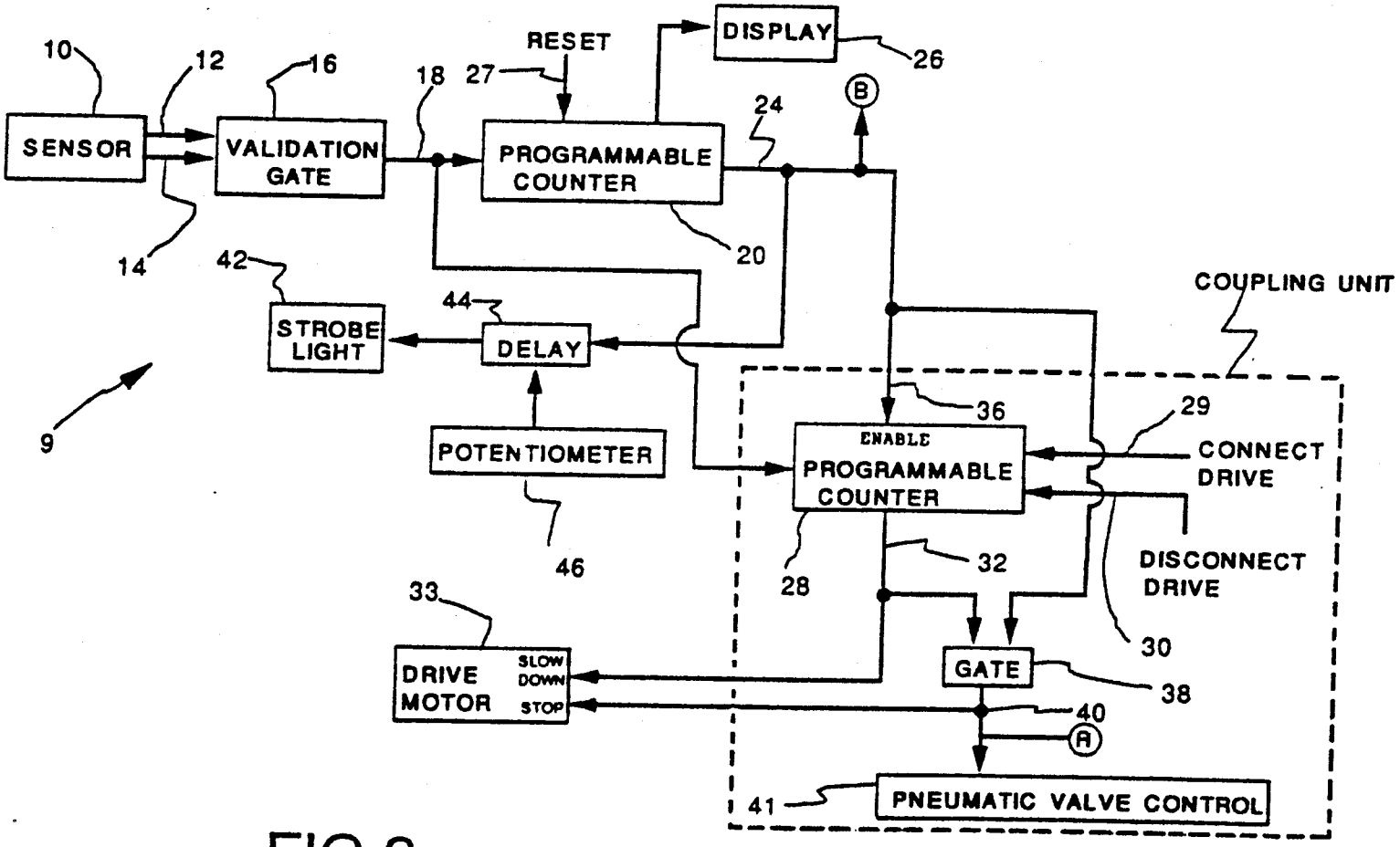
FIG. 2 is a block diagram of a system constructed in accordance with the invention for controlling the connection and the disconnection of a drive with a module of the press shown in FIG. 1.

With reference to FIG. 2, the system 9 comprises a rotary position encoder 10 which is driven by one of the cylinders of module 4. The position encoder 10 has two outputs 12 and 14 on which are produced pulses at different instants in time when the cylinder driving the encoder 10 is rotated to increment its peripheral position by a predetermined amount. For example, a pulse may be generated on outputs 12 and 14 when the cylinder is rotated by an amount to advance a point on its periphery by a distance of one half of an inch. With this arrangement, when the cylinder is continuously rotated, the outputs 12 and 14 produce two identical but out of phase signals which are representative of the peripheral position of the cylinder with respect to a fixed reference point.

The outputs 12 and 14 are connected to a validation gate 16 which generates on an output 18 a single position increment pulse when a pair of pulses have been sensed at different instants in time on the outputs 12 and 14 of the position encoder 10. A single pulse on any one of the outputs 12 or 14, or pulses occurring simultaneously are not sufficient to trigger the validation gate 16. For example, the validation gate 16 may be a latch, the outputs 12 and 14 being connected to the set and to the reset inputs of the latch, respectively.

A programmable counter 20 is connected to the output 18 to count the number of position increment pulses generated by the validation gate 16. The output of the counter 20 is continuously compared with a preset value and when the number of counts reaches the preset value a revolution pulse is generated on an output 24. The value at which the counter 20 is set corresponds to the number of peripheral position increments of the cylinder driving the position encoder 10 which are necessary to effect a complete revolution of the cylinder. For example, if a cylinder of 17 inches in circumference is being used and a position increment pulse is generated at every half of an inch travel, then the counter 20 is set to generate a revolution pulse when 34 counts have been recorded. Preferably, the counting cycle of the counter 20 is programmed by a set of mechanically operated switches allowing the operator of the press to conveniently enter the selected value.

The counter 20 also controls a display 26 to visually indicate the number of counts recorded by the counter 20 since the last revolution pulse.

The counter 20 is provided with a reset input 27 allowing to restore the counter to an initial value when the reset input is actuated. This feature is advantageous because it permits to arbitrarily fix the angular position of the cylinder driving the encoder 10, at which the revolution pulse will be generated. This adjustment is performed by operating the press under manual control slowly until the cylinder has reached the desired angular position. The drive of the press is then stopped and the reset 27 of the counter 20 is actuated. This position of the cylinder then constitutes a reference point at which the revolution pulses will be generated and at which the engagement and disengagement of the drive will occur as it will be described later.

The output 18 of the validation gate 16 is connected to the input of a programmable counter 28 similar in construction to the counter 20. The counter 28 generates a signal on output 32 when the number of position increment pulses recorded matches the value at which the counter 28 is set.

The counter 28 is normally inactive and is actuated in response to two conditions. The first condition is the reception on input 29 of a disconnect drive signal, or on input 30 a connect drive signal. These signals are provided by the operator of the press when desired to disengage a module from the drive or re-engage back a module, respectively. The second condition is the reception of a revolution pulse on input 36 after the connect drive or the disconnect drive signal has been received.

When the appropriate signals have been generated to actuate the counter 28, the latter produces a signal on output 32 when the number of counts than have been recorded matches the predetermined value. The signal on output 32 commands the drive motor of the press to slow down and continue advancing at a very slow speed. The value at which the counter 28 is set would normally be less than the number of increments required to effect a complete revolution of the cylinder to which the encoder 10 is coupled. This value is entered manually through mechanically operated switches as in the case of the counter 20.

A gate 38 receives the signal from output 32 and also the revolution pulses to issue a signal on output 40 commanding to the drive motor 33 to stop when the drive slow down signal and the revolution pulse are present simultaneously at the inputs of the gate. The signal on output 40 is also conveyed to a pneumatic valve control circuit 41 to unlock a valve and permit same to be operated to direct pressurized operating fluid to the desired location in order to mechanically connect or disconnect the selected module from the drive of the press.

The programmable counter 28, the gate 38 and the pneumatic valve control 41 constitute a coupling unit which controls the press drive and the mechanical components for connecting the drive to the press modules 1 to 4.

The system 9 also comprises a strobe light unit which is used to produce light busts in synchronism with the advancement of the web in order to provide a stationary image of the repeating web frames for inspection purposes. The strobe light unit comprises a strobe light 42 which is connected to the output of the counter 20 through a delay circuit 44. A manually controlled potentiometer 46 controls the delay provided by the circuit 44 in order to retard as desired the revolution signal pulses that are being sent to the strobe light 42. By adjusting the potentiometer 46, the delay to transmit the revolution pulses is varied allowing to generate the flash of light over a desired portion of the repeating frame on web. Accordingly, when the operator of the press wishes to inspect a certain portion of the frame, he adjusts the potentiometer so that the light flashes occur precisely when the desired portion of the frame passes beneath the strobe light 42.

Figure 3:
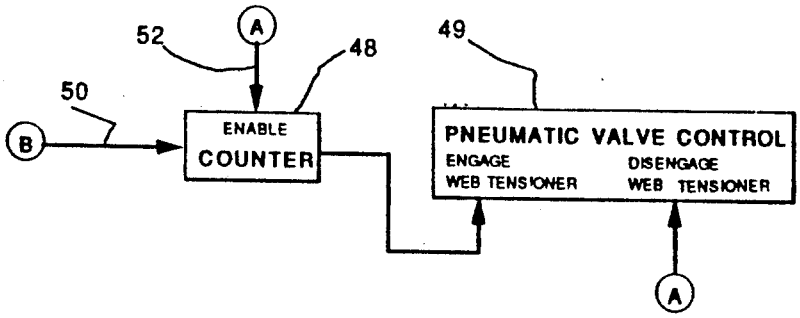
FIG. 3 is a block diagram of a system to control a web tensioner of the printing press shown in FIG. 1.

FIG. 3 illustrates a block diagram of a system used to control the web tensioner 7 of the printing press. More particularly, the system comprises a counter 48 which receives at an input 50 the revolution pulses from the programable counter 20. The counter 48 is actuated by injecting the signal from the output of the gate 38 into its enable input 52. The output of the counter 48 is connected to a pneumatic valve control 49, to signal the control to engage the web tensioner 7. The output 40 of the gate 38 is also connected to the pneumatic valve control 49 to signal the control to release the web tensioner 7 when a signal is generated by the gate 38.

Figure 5:
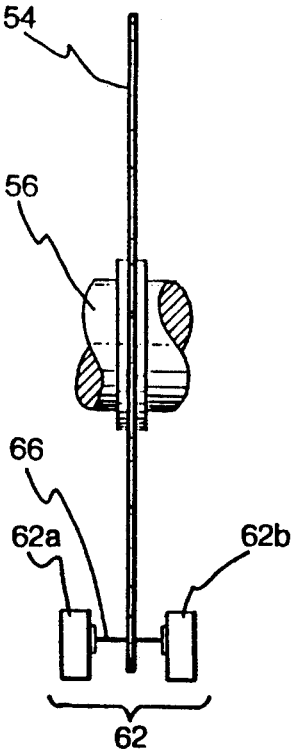
FIG. 5 is a side elevational view of the encoder wheel shown in FIG. 3.
Figure 4:
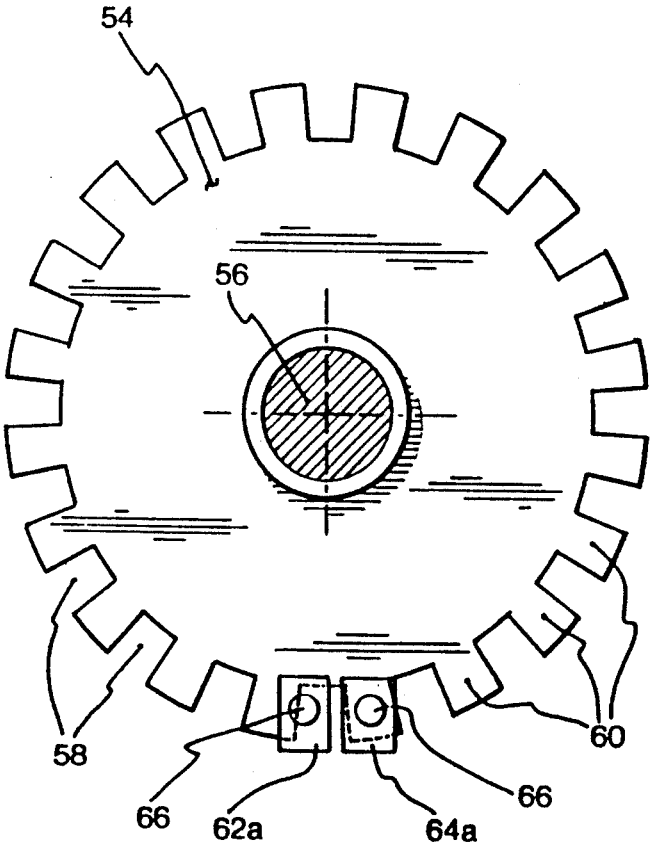
FIG. 4 is a front elevational view of an encoder wheel of the system in accordance with the invention.
Figure 6:
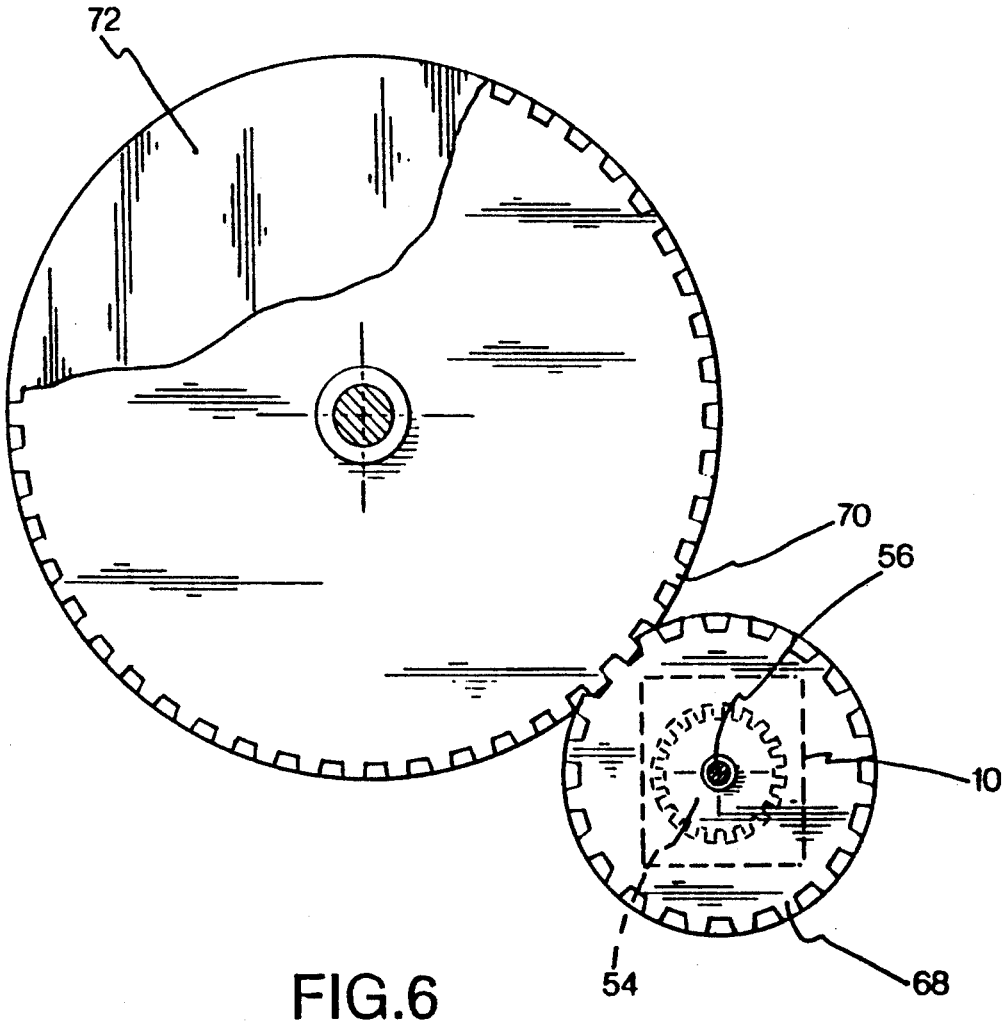
FIG. 6 is a schematical view illustrating the drive engagement between a rotary cylinder of the printing press and the encoder wheel shown in FIGS. 4 and 5.

FIGS. 4, 5 and 6 depict the physical structure of the position encoder 10 and the driving connection between a rotary cylinder of the module 4 of the printing press and the encoder.

More particularly, the position encoder 10 comprises an encoder wheel 54 rotatably mounted on an axle 56. On the periphery of the encoder wheel 54 are formed a plurality of equidistant apertures 58 spaced from one another by land areas 60. A pair of opto-electric sensors 62 and 64 (only one component of sensor 64 is shown in the drawings) are mounted in a spaced apart relationship adjacent the periphery of the encoder wheel 54. The sensor 62 comprises an emitter **62*a* generating a light beam 66 perpendicular to the plane of the encoder wheel 54, and a receiver 62*b* generating a signal when sensing the light beam 66. The structure of the opto-electric sensor 64 is identical to the sensor 62**.

The spacing between the opto-electric sensors 62 and 64 is such that they generate output pulses due to the intermittent blocking of the light beams 66 by the land areas 60, at different instants in time. As best shown in FIG. 4, and assuming that the wheel encoder 54 rotates in the clockwise direction, when the sensor 62 switches on as a result of an aperture aligning with the receiver **62*b*, the sensor 64 is still in a stable off condition and can be caused to switch only by further rotating the encoder wheel 54. By using the validation gate 16 which generates an output pulse in response to an output pulse from the sensor 62 and the sensor 64, false counts due to free play in the drive of the encoder wheel 54** are thus eliminated.

Preferably, the encoder wheel 54 and the sensors 62 and 64 are mounted in a housing (not shown in the drawings) to protect the assembly against contamination by dust.

If desired, several encoder wheels 54 may be mounted to the axle 56 in order to provide different number of pulses per axle revolution. In the example shown, the encoder wheel has 24 apertures. It may be envisaged to provide on the axle 56 an additional encoder wheel with 48 or 60 apertures for applications which require output pulses in response to smaller peripheral position increments of the cylinder driving the encoder wheel.

With reference to FIG. 6, the axle 56 on which the encoder wheel 54 is mounted is rotated by a gear 68 which is driven by a gear 70 mounted on the side of the rotary cylinder whose peripheral position is to be monitored by the position encoder. In the example shown, this cylinder is designated by the reference numeral 72 and it is mounted in the module 4 of the press. However, it should be understood that the position encoder 10 may be coupled to any suitable rotating member of the press, as dictated by the intended application.

The gear 70 is of the same diameter than the diameter of the cylinder 72, whereby the gear 68 is rotated at the same peripheral speed than the cylinder 72. By selecting the diameter of the gear 68 and the spacing of the apertures 58, so that an output pulse is generated in response to a predetermined peripheral position increment of the gear 68, say one half of an inch for example, the position encoder 10 will generate a pair of output pulses at different instants in time every time the cylinder 72 is rotated by one half of an inch. An important advantage of this system is the ability of the position encoder 10 to function with cylinders having various diameters because it is responsive to peripheral position increments.

Figure 7:
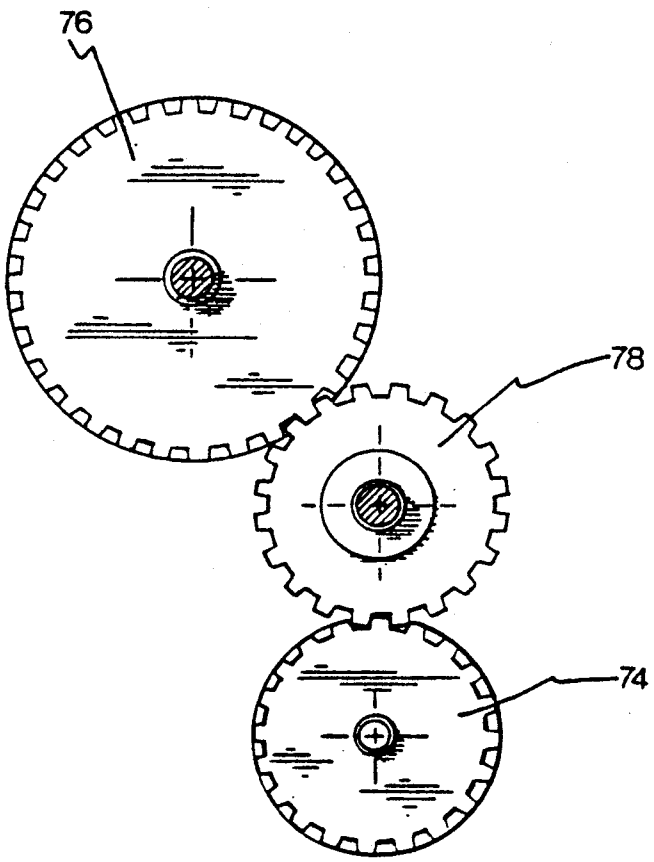
FIG. 7 is a side elevational view of a coupling element for selectively disengaging and re-engaging the drive of the printing press with a rotary cylinder of a module of the press, the coupling element being shown in a condition connecting the drive with the rotary cylinder.
Figure 8:
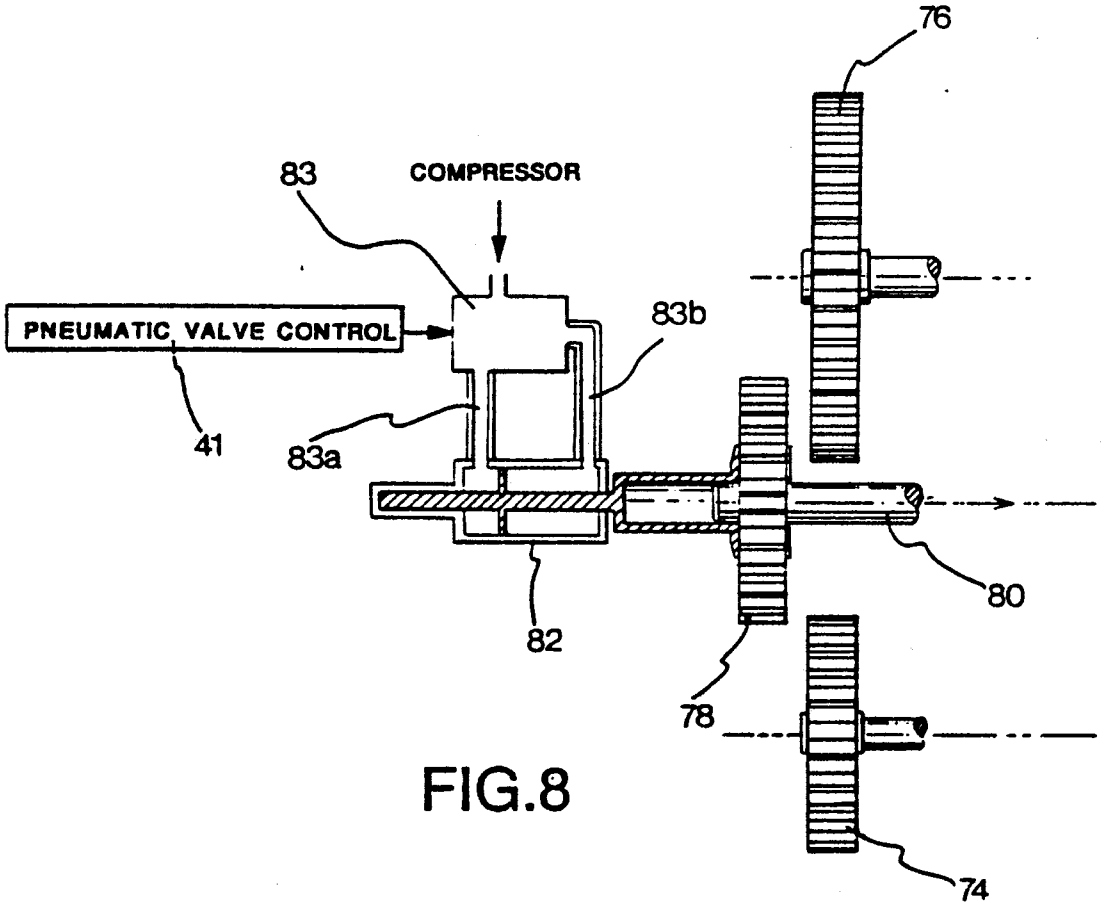
FIG. 8 is a front elevational view of the coupling element illustrated in FIG. 7, the coupling element being shown in a condition to disconnect the drive from the rotary cylinder.

FIGS. 7 and 8 illustrate a coupling element used for selectively connecting and disconnecting a drive gear to a rotary cylinder of the printing press that is to be engaged or disengaged from the drive. The drive gear, identified by the reference numeral 74 is connected to the prime mover of the press. The rotary cylinder, which is driven by the gear 74 is identified by 76. This cylinder may be any of the driven cylinders of the press, except the cylinder driving the position encoder 10. The connection between the gear 74 and the gear 76 is effected by an intermediary gear 78 slidingly mounted on an axle 80. The axial movement of the gear 76 is carried out by a pneumatic piston-cylinder assembly 82. In the position shown in FIG. 7, the coupling element is engaged, whereby the drive gear 74 rotates the cylinder 76. In FIG. 8, the coupling element is shown in the disengaged condition.

The pneumatic piston-cylinder assembly is controlled by a valve 83 which receives compressed air from a suitable source, such as an air compressor, and directs the operating fluid on either one of two lines 83*a* and 83*b* in order to extend or retract the piston-cylinder assembly 82. The valve 83 can be operated manually or an automatic control thereof may be devised. The valve 83 responds to manual or automatic commands as the case may be only when enabled by the pneumatic valve control 41.

Figure 9:
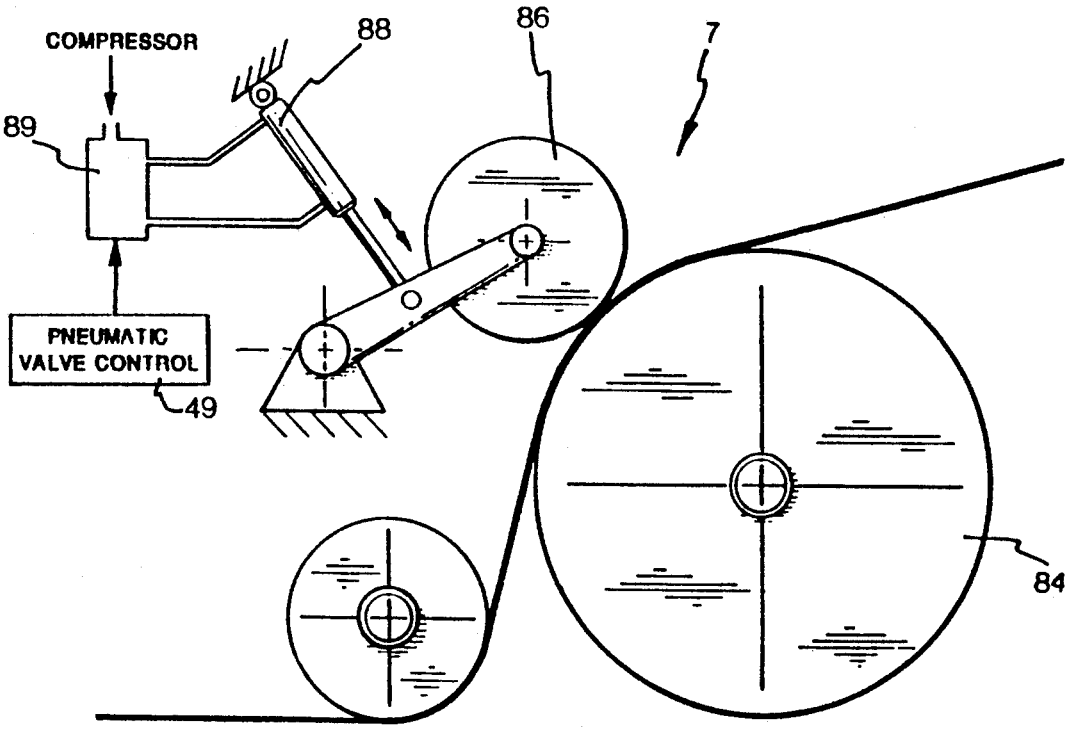
FIG. 9 is an enlarged schematical view of the web tensioner mechanism of the printing press of FIG. 1.

FIG. 9 depicts the structure of the web tensioner 7. It comprises a cylinder 84 on which the web supplied to the module 1 of the printing press passes. A roll 86 is pressed against the cylinder 84. The roll 86 is pivotally mounted to the frame of the press and it can be pivoted in and out of contact with the web by a pneumatic piston-cylinder assembly 88. In the position shown in FIG. 9, the roll 86 firmly engages the surface of the cylinder 84 in order to prevent web slippage, thereby maintaining the web tension. To disengage the web tensioner 7, the pneumatic piston-cylinder assembly 88 is contracted to raise the roll 86.

The piston-cylinder assembly 88 is controlled by a valve 89, similar to the valve 83, in turn controlled by the pneumatic valve control 49.

The operation of the system 9 will now be described. Most preferably, the position encoder 10 is installed in the module 4 of the press and it is driven by a rotary cylinder of that module. All the other press modules are coupled to the prime mover of the press by means of coupling elements shown in FIGS. 7 and 8.

Before starting the press, the system 9 is programmed in accordance with the parameters of the press. The programmable counter 20 is set to count to the number of position increment pulses necessary to effect a complete rotation of the rotary cylinder driving the position encoder. For example, when the position encoder is such that a peripheral position increment of one half of an inch of the gear 68 generates one position increment pulse, and the circumference of the cylinder is of 17 inches, the counter is set at 34, whereby when 34 pulses have been recorded by the counter a revolution pulse is generated indicating that the cylinder has completed one turn.

The programmable counter 28 is set to a value at which the drive motor of the press will decelerate and continue running at a very slow speed until it is stopped completely. The value at which the counter 28 is set is less than what is required to effect a complete revolution of the cylinder driving the position encoder. For the values mentioned previously, the counter 28 is set at 15, for example. As a result, when the signal disconnect drive is provided by the operator, the counter 28 will cause the drive motor to slow down 15 position increment pulses after the last revolution pulse.

Before the printing press is started, the drive motor is operated under manual control to bring the cylinder in the module 4 which drives the position encoder at the desired angular position. This adjustment is a matter of preference for the operator. When the desired position has been reached, the reset input 27 of the counter 20 is actuated to set the reference point by restoring the counter 20 to zero. The press is then operated in the normal fashion.

When it is desired to disconnect the module 3 for example, from the drive in order to run the modules 1 and 2 for maintenance purposes without running the module 3, a disconnect drive signal is provided by the operator to enable the counter 28. When the counter receives the next revolution signal it starts counting the number of position increment pulses received from the validation gate 16. When 15 pulses have been recorded, a signal is generated on output 32, causing the drive motor to decelerate and continue advancing at a very slow speed. When the next revolution signal is generated, the gate 38 generates a signal on output 40 to stop the drive motor, and unlock the valves 83 and 89, whereby the piston-cylinder assemblies 82 and 88 may be operated to disengage the gear 78 and raise the roll 86.

The purpose of delaying the actuation of the counter 28 until the a revolution pulse has been sensed after the disconnect drive signal has been received is to provide ample time for the press drive from decelerating and stop at the reference point. Without such feature, in a situation when the disconnect drive signal is provided immediately before the cylinder driving the position encoder has reached the reference point, the drive will likely overshoot the reference point.

The coupling element of module 3 is disconnected by operating the valve 83 to contract the piston-cylinder assembly 82 and the drive of the press is actuated to run the modules 1, 2 and 4 in order to perform the desired maintenance procedure.

The module 3 of the press is re-engaged back on the drive by following the procedure outlined above, whereby the press is brought to a full stop at the reference point to allow the coupling element of module 3 to be re-engaged in phase with the remaining modules.

The operation of the press is then resumed by starting the drive motor of the press. Simultaneously, the counter 48 is set in operation to count the number of revolution pulses. When the number of recorded pulses reaches a predetermined number, say 10, the counter generates a signal commanding valve control 49 to actuate the valve 89 to extend the piston-cylinder assembly 88, whereby the roll 86 of the web tensioning mechanism to engages the cylinder 84. The purpose of delaying the engagement of the web tensioning mechanism is to allow the press to pick-up the slack in the web.

The control system 9 is constructed from basic logic gates, such as counters, timers, etc. A detailed description of the electric circuit is not deemed to be necessary to carry out the invention as the realisation of the circuit is well within the reach of a man skilled in the art. It may also be envisaged to use a programmable microprocessor instead of hard-wired logic, however a processor controlled system may not necessarily by desirable because it slower, more expensive and complex.

The above description of a preferred embodiment is given only as an example of the invention and should not be construed in any limiting manner as variations and refinements are possible without departing from the spirit of the invention. The scope of the invention is defined in the appended claims.

I claim:

1. A system for controlling the connection and disconnection of a drive to a rotary cylinder of a printing press, said system comprising:

a position encoder coupled to a first rotary cylinder of the printing press for generating two pulses occurring at different instants in time when said first cylinder is rotated to increment its peripheral position by a predetermined amount, whereby when said first cylinder is continuously rotated the position encoder produces two out of phase pulse signals representative of the peripheral position of a first cylinder with respect to a fixed reference point;

a validation gate receiving said out of phase signals and generating a single position increment pulse in response to a pulse from each of said out of phase signals;

a counter for counting said position increment pulses and generating a revolution pulse when said first cylinder effects a complete revolution with respect to said fixed reference point; and a coupling unit connecting the drive with a second cylinder, said coupling unit being responsive to said counter and being selectively de-actuatable to terminate a driving relationship between said drive and said second cylinder when said drive is at a position reached at an instant determined by the time of origin of a revolution pulse, said coupling unit being selectively actuatable to re-establish said driving relationship when said drive is at the last mentioned position, whereby said drive is disconnected from and connected back to said second cylinder when said first cylinder is at the same position with respect to said fixed reference point, thereby allowing to re-acquire the registration between said cylinders existing before the drive has been disconnected from said second cylinder

2. A device as defined in claim 1, wherein said counter generates said revolution signal when the number of counted position increment pulses reaches a preset number which corresponds to the number of peripheral position increments of said first cylinder necessary to effect a complete revolution thereof.

3. A device as defined in claim 2, wherein said counter includes a reset input which upon enablement restores said counter to an initial value.

4. A device as defined in claim 3, further comprising a display to visually indicate the number of counted position increment pulses.

5. A device as defined in claim 1, further comprising a strobe light producing a flash of light in response to a revolution pulse.

6. A device as defined in claim 5, comprising an adjustable delay circuit for delaying said revolution pulse by a certain time period in order to retard the actuation of said strobe light.

7. A device as defined in claim 1, further comprising:

a first gear connected to said drive;

a second gear connected to said second cylinder;

a third gear capable to assume an operative and a non-operative conditions, in said operative condition said third gear establishing a driving relationship between said first and second gears, in said non-operative relationship said third gear terminating said driving relationship, thereby allowing said drive to rotate said first cylinder without rotating said second cylinder.

8. A device as defined in claim 1, further comprising a drive control for stopping said drive in response to said revolution signal when a de-actuation command is applied to said coupling unit.

9. A device as defined in claim 8, further comprising counter means for counting said position increment pulses and generate a drive slow-down signal which causes said drive to operate at a slow speed when the number of position increment pulses reaches a value less than the number of peripheral position increments of said first cylinder necessary to effect a complete revolution thereof.

10. A device as defined in claim 9, wherein said counter means includes an input receiving said revolution pulse which causes said counter means to start counting, whereby a first revolution pulse initiates operation of said counter means which after a predetermined number of position increment pulses causes said drive to slow-down, and a second revolution pulse causes said drive to stop said first cylinder at said fixed reference point.

11. A device as defined in claim 1, wherein said position encoder comprises;

an encoder wheel coupled to said first cylinder to rotate therewith;

a pair of sensors in a spaced apart relationship, adjacent to said encoder, each sensor generating an output pulse when said encoder wheel is rotated by a predetermined amount.

12. A device as defined in claim 11, wherein said sensors are opto-electrical.

13. A device as defined in claim 11, wherein said encoder wheel comprises a peripheral zone including apertures spaced from one another by land areas, each sensor being responsive to a change of condition of said peripheral zone from an aperture to a land area and vice versa.

14. A device as defined in claim 13, wherein said sensors are spaced apart by a distance such that a change of condition is sensed by each sensor at different angular positions of said encoder wheel.

* * * * *